United States Patent [19]

Gershoni

[11] Patent Number: 4,651,357

[45] Date of Patent: Mar. 24, 1987

[54] HELMET MIRROR

[76] Inventor: Yoram Gershoni, 65 Tzippori Street, Nazareth Elite, Israel

[21] Appl. No.: 738,026

[22] Filed: May 24, 1985

[30] Foreign Application Priority Data

May 31, 1984 [IL] Israel ..... 71978
Feb. 1, 1985 [IL] Israel ..... 74220

[51] Int. Cl.[4] ..... A42B 3/02
[52] U.S. Cl. ..... 2/422; 2/424; 350/638
[58] Field of Search ..... 2/422, 13, 10, 410, 2/424, 425; 350/638

[56] References Cited

U.S. PATENT DOCUMENTS

| | | | |
|---|---|---|---|
| 3,594,069 | 7/1971 | Harvey | 350/638 |
| 3,804,495 | 4/1974 | Rayow et al. | 2/422 X |
| 3,978,526 | 9/1976 | Mitchell et al. | 2/422 |
| 4,385,811 | 5/1983 | Nava | 350/638 |
| 4,490,012 | 12/1984 | Magiske | 350/638 |

*Primary Examiner*—Peter Nerbun
*Attorney, Agent, or Firm*—Abelman Frayne Rezac & Schwab

[57] ABSTRACT

Rear view mirror apparatus for side mounting on the face shield or on the helmet shell of a protective helmet comprising: a mirrored surface; a module for holding the mirrored surface and having a transparent aerodynamically configured outer surface; the apparatus being adapted for attachment to the face shield or to the helmet shell.

5 Claims, 5 Drawing Figures

HELMET MIRROR

FIELD OF THE INVENTION

The present invention relates to mirror apparatus in general and, in particular, to rear view mirror apparatus for motorcycle helmets.

BACKGROUND OF THE INVENTION

Motorcyclists, race drivers, and other persons who wear protective helmets have a limited field of vision due, in part, to the helmet itself. In order to see what is occurring to the side or rear of the helmet wearer, he must turn his head to look. Needless to say, during the time his head is turned, he is unable to see what is happening in front of him. Thus, the problem of increasing the field of vision of a helmet wearer is a serious one requiring a solution both for the helmet wearer and for other persons and vehicles on the road with the wearer.

The first solutions to this problem involved mounting an ordinary mirror on the handlebars of the cycle. This solution has four disadvantages. First, the vibration of the handle bars distorts the reflected image in the mirror. Second, such mirrors generally also require the wearer to turn his or her head to see what is reflected therein. Third, the mirror cannot be used while turning the handlebar. Fourth, the area of such a mirror is relatively large, causing more drag.

There is shown in U.S. Pat. No. 3,978,526 a periscope rear view helmet and helmet adapter including a mirror optical system supported in a tunnel disposed forwardly of the frontal area of the helmet comprising a reflecting mirror for reflecting an image received from a scanning mirror positioned adjacent the crown of the helmet to a viewing mirror which reflects the images to the wearer's eyes.

U.S. Pat. No. 3,804,495 discloses a rear view reflection device for a helmet including a single reflected surface prism mounted on an upright support attached to the visor of the helmet with an adjustable mirror at the other end of the support. The mirror provides a rear view reflected sight line to the prism which is normally positioned above the normal forward line of sight of the wearer.

There is disclosed in U.S. Pat. No. 3,594,069 an integral rear view mirror face shield for use with a protective helmet. The mirrored surface is positioned below the eye level of the user and is substantially the same width as the face shield permitting a practical focal length within a relatively clean aerodynamic and compact configuration by utilizing a rearward line of sight below the maximum width of the protective helmet. Areas which are obstructed by the user's neck and the protective helmet come into view when the user turns his head. This configuration is stated as having been chosen in preference to placing a mirrored surface to the sides or above the user's eyes in order to avoid blocking his forward view and because locating the mirrored surface in this manner at a practical focal length results in a cumbersome configuration.

SUMMARY OF THE INVENTION

It is an object of the present invention to provide a protective helmet including rear view mirror apparatus of simple design and construction which permits unobstructed front viewing virtually simultaneously with rear viewing without the need for the wearer to turn his head, and which is entirely suitable for high speed motion.

There is thus provided in accordance with the present invention rear view mirror apparatus for side mounting on the face shield or on the helmet shell of a protective helmet comprising: a mirrored surface; a module for holding the mirrored surface and having a transparent aerodynamically configured outer surface; the apparatus being adapted for attachment to the face shield or to the helmet shell. In one embodiment of the invention, the mirrored surface is defined by a lateral portion of a forward facing face. Preferably the mirrored surface is generally rectangular in shape. It is moreover preferred that the mirrored surface is slightly curved and extends outwardly of the tangent of the outermost side point of the face shield or of the helmet shell. It will be understood that the mirrored surface may in one embodiment be adjustable relative to the module.

In another aspect, the invention provides a protective helmet comprising: a helmet shell; a face shield attached to the helmet shell so as to pivot thereon; and rear view mirror apparatus for side mounting on the face shield or on the helmet shell of the protective helmet comprising: a mirrored surface; a module for holding the mirrored surface and having a transparent aerodynamically configured outer surface; the mirror apparatus being adapted for attachment to the face shield or to the helmet shell. In one embodiment of this aspect of the invention, the mirrored surface is defined by a lateral portion of a rearward facing face of the module, and the forward facing face preferably is generally rectangular in shape. In this aspect of the invention also, the mirrored surface may extend outwardly of the tangent of the outermost side point of the face shield or of the helmet shell. Moreover, it will be undersood that in this aspect of the invention, the mirrored surface may in one embodiment be adjustable relative to the module.

According to a preferred embodiment of the invention, the face shield apparatus and the rear view mirror apparatus are integrally formed.

According to an alternate preferred embodiment, the face shield apparatus and the rear view mirror apparatus are not integrally formed.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
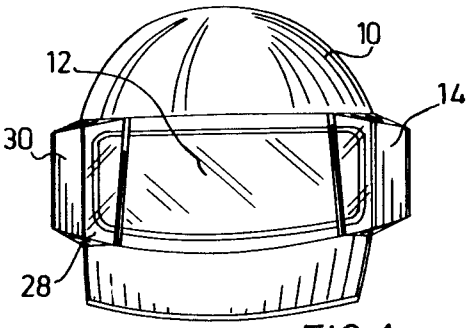
FIG. 1 is a front view of a helmet with mirror apparatus constructed and operative in accordance with an embodiment of the present invention.
Figure 2:
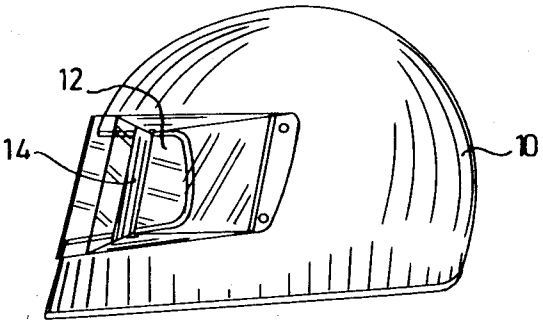
FIG. 2 is a side view of the helmet of FIG. 1.
Figure 3:
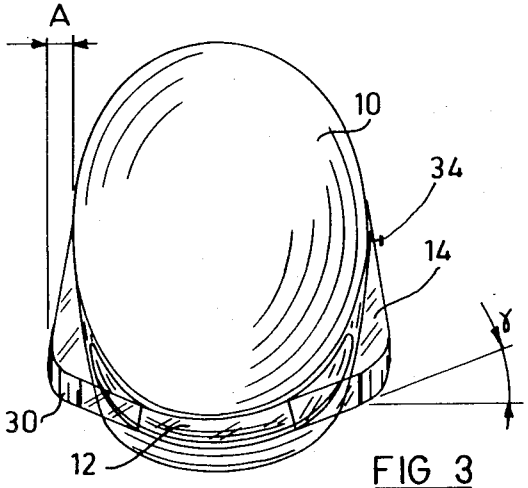
FIG. 3 is a top perspective view of the helmet of FIG. 1.

With reference to FIGS. 1, 2 and 3 there is shown a protective helmet constructed and operative in accordance with the present invention and comprising a helmet shell 10 which may comprise any conventional helmet shell. Mounted on helmet shell 10 are a face shield 12 and rear view mirror apparatus 14, the outer edge of which is curved to ensure aerodynamic configuration. According to one embodiment of the invention, face shield 12 and rear view mirror 14 are integrally formed. According to an alternate embodiment, face shield 12 and/or rear view mirror 14 are separate elements, face shield 12 being affixed to the helmet shell, and rear view mirror 14 being affixed to helmet shell 10 or to face shield 12.

Figure 4:
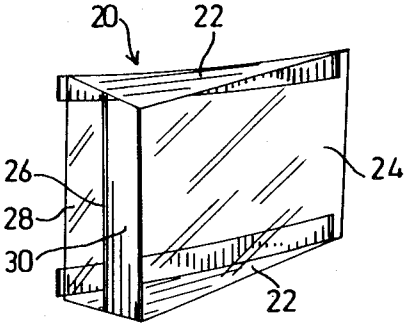
FIG. 4 is a perspective side view of mirror apparatus coupleable to a protective helmet constructed and operative in accordance with an alternate embodiment of the invention.
Figure 5:
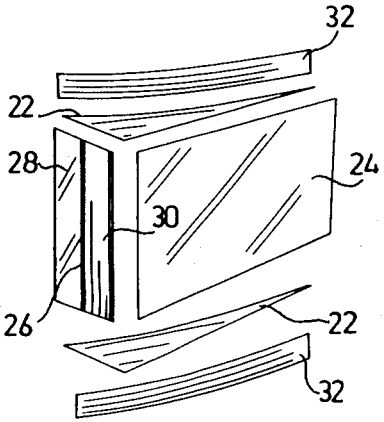
FIG. 5 is an exploded view of the mirror apparatus of FIG. 4.

The rear view mirror apparatus of the present invention comprises a member 20 member, which is further illustrated in respective assembled and exploded views in FIGS. 4 and 5. Member 20, which may be constructed of any plastic material, is hollow both to minimize weight and to allow for mirror position change.

Hollow member 20 defines top and bottom substantially triangular parallel or nearly parallel surfaces 22 and a side surface 24, which ensure aerodynamic configuration. Member 20 further defines a forward facing rectangular surface 26. Side surface 24 is coupled at the rearward end thereof to the helmet shell 10 or face shield 12 and at the forward end thereof to the forward facing surface 26. As can be seen in FIG. 3, side surfaces 24 extend a distance A on either side of the helmet shell.

Forward facing surface 26 comprises a transparent interior portion 28 and a lateral mirrored portion 30. Mirrored portion 30 is preferably constructed by silvering the front thereof using a known method, such that angle adjustment is possible. The art of silvering mirrors is well known, and, as such forms no part of the present invention. It is a particular feature of the present invention that mirrored portion 30 is also of width A, that is to say, it is equal to the distance between the outermost extent of side surface 24 and the tangent to the outermost side extent of the helmet shell, as depicted in FIG. 3. This means that the wearer has an unobstructed rear view along the sides of the helmet shell by glancing at the mirrored section. Simultaneously, the wearer has an unobstructed front view through the transparent interior portion 28. Rear and peripheral visions may overlap minimally, but this overlap can be eliminated completely if desired.

In the alternate embodiment according to which face shield 12 and rear view mirror 14 are separate elements, rear view mirror 20 may further comprise mounting strips 32 coupled to the top and bottom thereof for gripping face shield 12. Mounting strips 32 are held in place by parallel surfaces 22. A screw or rivet 34 may be used to affix mirror 14 to face shield 12.

It will be appreciated by those skilled in the art that the present invention is not limited to what has been shown and described hereinabove by way of example. Rather, the scope of the claims is limited solely by the claims which follow.

I claim:

1. A rear view mirror assembly for mounting on a protective helmet providing a visor opening, comprising a hollow module formed from a transparent material and having an aerodynamically configured outer surface, said module including:

a frontal member, a substantially planar side member connected to said frontal member and extending substantially perpendicular thereto, and, substantially triangular top and bottom gusset members respectively connected to the top and bottom edges of said frontal and side members to provide a hollow, structurally strong and rigid unit;

a mirrored surface associated with a rear face of said frontal member and extending in a vertical strip between said top and botom members; and, means for attaching said unit to a said helmet with said mirrored surface facing towards said visor opening and positioned forwardly of eyes of a user of the helmet, said mirrored surface extending laterally beyond a tangent to said helmet passing through said frontal member.

2. The rear view mirror assembly of claim 1, in which a said mirror assembly is positioned adjacent one lateral edge portion of a transparent eye shield adapted to extend across the front of said visor opening of said helment and an identical said mirror assembly is positioned adjacent an opposite lateral edge portion thereof.

3. The rear view mirror according to claim 1, in which said mirrored surface is a rear surface of said frontal member.

4. The rear view mirror assembly of claim 1, in which said mirrored surface is provided on a member positioned behind and adjacent the rear face of said frontal member.

5. The rear view mirror of claim 1, in which said mirrored surface is planar.

* * * * *